US011344478B1

(12) United States Patent
Matias

(10) Patent No.: US 11,344,478 B1
(45) Date of Patent: May 31, 2022

(54) BABY BOTTLE COVER

(71) Applicant: Natara Matias, Bronx, NY (US)

(72) Inventor: Natara Matias, Bronx, NY (US)

( * ) Notice: Subject to any disclaimer, the term of this patent is extended or adjusted under 35 U.S.C. 154(b) by 50 days.

(21) Appl. No.: 17/105,559

(22) Filed: Nov. 26, 2020

(51) Int. Cl.
*A61J 9/08* (2006.01)

(52) U.S. Cl.
CPC ..... *A61J 9/085* (2013.01); *A61J 2200/00* (2013.01)

(58) Field of Classification Search
CPC .. A61J 2200/00; A61J 9/00; A61J 9/08; A61J 9/005; A61J 9/06; A61J 9/0623; A61J 9/063; A61J 9/008; A61J 9/0075; A61J 9/085; B65D 43/02; B65D 43/0202; B65D 43/0233; B65D 41/22
See application file for complete search history.

(56) References Cited

U.S. PATENT DOCUMENTS 2,172,544 A * 9/1939 Panter ..... B65D 39/02 215/45
3,214,053 A * 10/1965 Robertson ..... A61J 11/045 215/11.1
3,507,416 A * 4/1970 Rohe ..... B65D 25/20 229/89
5,404,033 A * 4/1995 Wong ..... H01L 27/118 257/209
6,260,729 B1 * 7/2001 Mitchell ..... B65D 41/22 220/780
6,276,551 B1 * 8/2001 Miller, II ..... B65D 41/22 215/319
8,132,682 B1 * 3/2012 Chackonal ..... A61J 9/08 215/386
9,848,721 B2 * 12/2017 Turner ..... A61J 11/045
2018/0344576 A1 * 12/2018 Somsen ..... A61J 9/085

* cited by examiner

*Primary Examiner* — Don M Anderson

(74) *Attorney, Agent, or Firm* — Michael J. Feigin, Esq.; Feigin and Fridman LLC

(57) ABSTRACT

A baby bottle including an accordion cover is disclosed herein. The bottle has a nipple connected at an open end, with a collar removably connected at a meeting point of the bottle and the nipple. The accordion cover is connected to the collar, and may be movable, while remaining fixedly connected to the collar, between an upward configuration, a downward configuration, and a compressed configuration. The nipple is covered and protected from contamination.

17 Claims, 7 Drawing Sheets

BABY BOTTLE COVER

FIELD OF THE DISCLOSED TECHNOLOGY

The disclosed technology relates generally to a baby bottle nipple cover, and more specifically to a baby bottle cover which is adapted to fit around a nipple cover of the baby bottle.

BACKGROUND

Of all members of society, bottle-feeding infants and toddlers are particularly vulnerable to disease, infection as well as unwanted dirt, dust and debris/bacteria/microorganisms that baby nipples are prone to. As a part of preventing infant disease, and increasing baby feedings/intake it is necessary to ensure that baby bottles and nipples remain clean and free of contamination. This is typically done using a detachable cover fitted around the nipple of the baby bottle. These covers, however, are easily misplaced, lost, contaminated when the bottle is in use or is being washed, making them less effective. Additionally, they are often made of a rigid plastic, and are easily knocked off or even broken when the bottle is dropped.

Thus, there is a need for a baby bottle cover which is non detachable from the bottle itself but removable exposing the nipple for feedings thus making the bottle cover beneficial without being easily misplaced, and which is constructed in a more well-connected and durable manner reducing the risk of contamination and infection to baby/toddler. This and other problems are solved by embodiments of the disclosed technology, as described below.

SUMMARY OF THE DISCLOSED TECHNOLOGY

A baby bottle of embodiments of the disclosed technology has a bottle with a nipple connected at the collar which is screwed to the bottle, in embodiments of the disclosed technology, at an open end thereof. It further has a collar removable connected at a meeting point of the bottle and the nipple, with an accordion cover connected to the collar.

"A meeting point of the bottle and the nipple" is defined as a horizontal plane at which a lowest circular or ovoid cross section of the nipple is above a highest circular or ovoid cross section of the bottle, the plane being parallel to both the lowest circular or ovoid cross section of the nipple as well as to the highest circular or ovoid cross section of the bottle. An "accordion cover" is defined as a cover which, when compressed, is arranged in substantially regular pleats. revealing the nipple for feedings and when extended, covering the nipple for prevention and protection of cross contaminations.

In a compressed condition, in some embodiments, the cover has a width equal to or less than the height of a groove in the collar. Additionally, in embodiments, an upper and lower end of the collar frictionally prevent the cover in the compressed condition from decompressing. The cover is fixedly connected to the groove in the collar, in various embodiments.

The height of the groove is defined as the vertical distance between a point on a lower edge of the groove and a corresponding point on a higher edge of the groove when the baby bottle is in a recognizably upright position, and/or as a shortest possible vertical distance between a point on one edge of the groove and a point on an opposite edge of the groove. "Fixedly connected" is defined as being connected strongly, such that the connection can only be broken by regular human force by one of the connected objects being torn or otherwise broken.

Frictional prevention is defined as a surface having a coefficient of static and/or kinetic friction which is high enough to prevent one surface from sliding along another. Friction is defined as "resistance that one surface or object encounters when moving over another" and/or as "a force resisting relative motion of solid surfaces, fluid layers, and/or material elements sliding against each other".

The cover, in some embodiments, is extendable in an upward configuration covering the nipple while an end of the cover is within and fixedly connected to the groove of the collar. In other embodiments, the cover is extendable in a downward configuration covering at least a portion of the bottle while an end of the cover is within and fixedly connected to the groove of the collar. In further embodiments, the cover is extendable in both an upward and a downward configuration, relative to the groove of the collar, while remaining fixedly connected to the groove of the collar, blocking transfer of bacteria thorugh the groove in embodiments of the disclosed technology. An end of the cover unconnected to the groove extends past the top of the collar around least a part of, or entire, nipple when in the upright configuration and extends past the bottom of the collar around at least a part of the baby bottle when in the downward configuration.

"Upward configuration" is defined as a state in which one end of the cover is fixedly connected to the groove of the collar while an opposite end is extended upward relative to the groove of the collar and is outside of the groove of the collar. "Downward configuration" is defined as a state in which one end of the cover is fixedly connected to the groove of the collar while an opposite end is extended downward relative to the groove of the collar and is outside of the groove of the collar. "Top of the collar" is defined as an uppermost and substantially planar surface of the collar which is perpendicular to an upwardly-extending vector.

In some embodiments, a circumference of the cover becomes smaller when uncompressed in the upward configuration. In further embodiments, the cover surrounds, and is in contact with, a plurality of outer side circular cross-sections of the bottle when in a lowered position.

"A circumference of the cover" is defined as a circumference of an ovoid horizontal cross section of the cover which lies in a plane substantially perpendicular to an upwardly-extending vector and/or which lies in a horizontal plane. "Outer side" is defined as a side of the bottle opposite a side which is in contact with an interior space of the bottle and/or a side which is not in contact with an interior space of the bottle.

The groove of the collar has therein, in various embodiments, a plurality of circumferentially spaced-apart pits, and the cover has a plurality of circumferentially spaced-apart flanges, each flange of the plurality of flanges corresponding to a pit of the plurality of pits. The cover is prevented, in embodiments, from rotating relative to the collar, due to the plurality of spaced-apart flanges being within the plurality of spaced-apart pits within the groove, while the cover extends in a direction transverse to the circumferential arrangement of pits within the groove of the collar.

In other embodiments, the cover has an internally-extending connection mechanism, the mechanism being fixedly attached within the groove of the cover.

"Internally-extending" is defined as extending towards a space enclosed by a circumference of the cover.

A baby bottle cover of embodiments of the disclosed technology has a collar threadedly attachable to a bottle, and an accordion cover. The cover is connected to an externally-oriented circumferential groove of the collar. In various embodiments, the cover is fixedly attached to the collar.

"Externally-oriented" is defined as facing toward a space external to the cover and/or collar. "Circumferential groove" is defined as a groove which lies on substantially every point of at least one ovoid cross section of the collar, the ovoid cross section lying in a plane which is perpendicular to an upwardly extending vector.

The cover, in some embodiments, is stretchable away from the collar in each of two opposing directions while substantially retaining circumferential or ovoid cross sections vertically between the groove and an extremity of the cover furthest away from the groove. In one of the opposing directions, in embodiments, an opening of the bottle is in between the groove and an edge of the cover furthest from the groove. A part of the cover above the opening has ovoid cross-sections, in various embodiments. In another of the opposing directions, the cover retains the ovoid cross-sections and is circularly abutted against at least a portion of the bottle.

"Stretchable" is defined as capable of moving in a direction when pulled and/or pushed in that direction and/or maintaining a shape after being pushed and/or pulled into that shape.

Cardinal directions used in this disclosure are with reference to a common way the devices disclosed are used. This is for convenience of the description thereof and is not limiting the scope of the technology. Thus, "top" and "up" generally refer to a vector direction towards an opening and/or nipple of the baby bottle and away from an inside of the baby bottle, whereas "bottom" and "down" generally refer to a substantially opposite vector direction thereof.

Any device or step to a method described in this disclosure can comprise or consist of that which it is a part of, or the parts which make up the device or step. The term "and/or" is inclusive of the items which it joins linguistically and each item by itself.

DETAILED DESCRIPTION OF EMBODIMENTS OF THE DISCLOSED TECHNOLOGY

A baby bottle including an accordion cover is disclosed herein. The bottle has a nipple connected at an open end, with a collar removably connected at a meeting point of the bottle and the nipple. The accordion cover is connected to the collar, and may be movable, while remaining fixedly connected to the collar, between an upward configuration, a downward configuration, and a compressed configuration.

Embodiments of the disclosed technology will become more clear in view of the following discussion of the figures.

Figure 1:
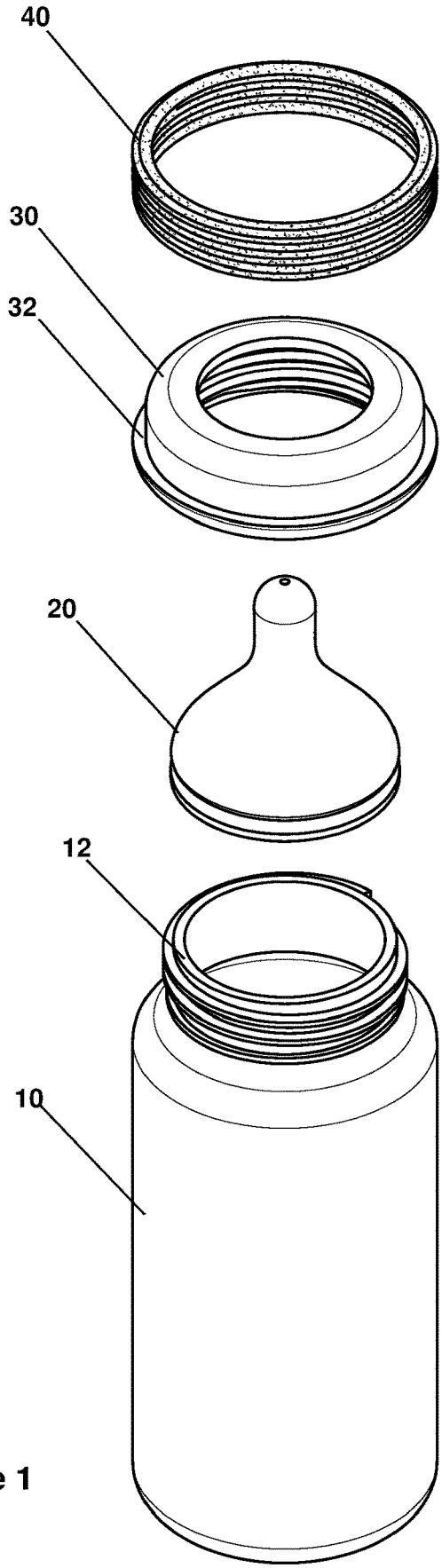
FIG. 1 shows an exploded front and side perspective view of the components of the baby bottle of embodiments of the disclosed technology, with the cover in a compressed configuration.

FIG. 1 shows an exploded front and side perspective view of the components of the baby bottle of embodiments of the disclosed technology, with the cover in a compressed configuration. A bottle 10 has an open end 12, at which a nipple 20 is removably connected. A collar 30 is removably connectable at and around a meeting point between the bottle 10 and the nipple 20. An accordion cover 40 may be fixedly or removably connected to the collar 30.

In various embodiments, the accordion cover 40 may be fixedly or removably connected to a groove 32 within the collar 30. In the embodiment shown, the groove 32 is defined by a lower ridge only. In other embodiments, the groove 32 may be defined by an upper ridge and/or a lower ridge. The groove may further be made of several grooves. The accordion cover 40, in some embodiments, may be at least two accordion covers 40, each of which may be fixedly and/or removably connected to a same and/or to a different groove 32 of the collar 30. In still further embodiments, any and all ridges defining a groove 32 may exist at substantially every point on a circumference of the collar 30. The accordion cover 40 may be connected to a lower part, middle part, and or upper part of the groove 32.

Figure 2:
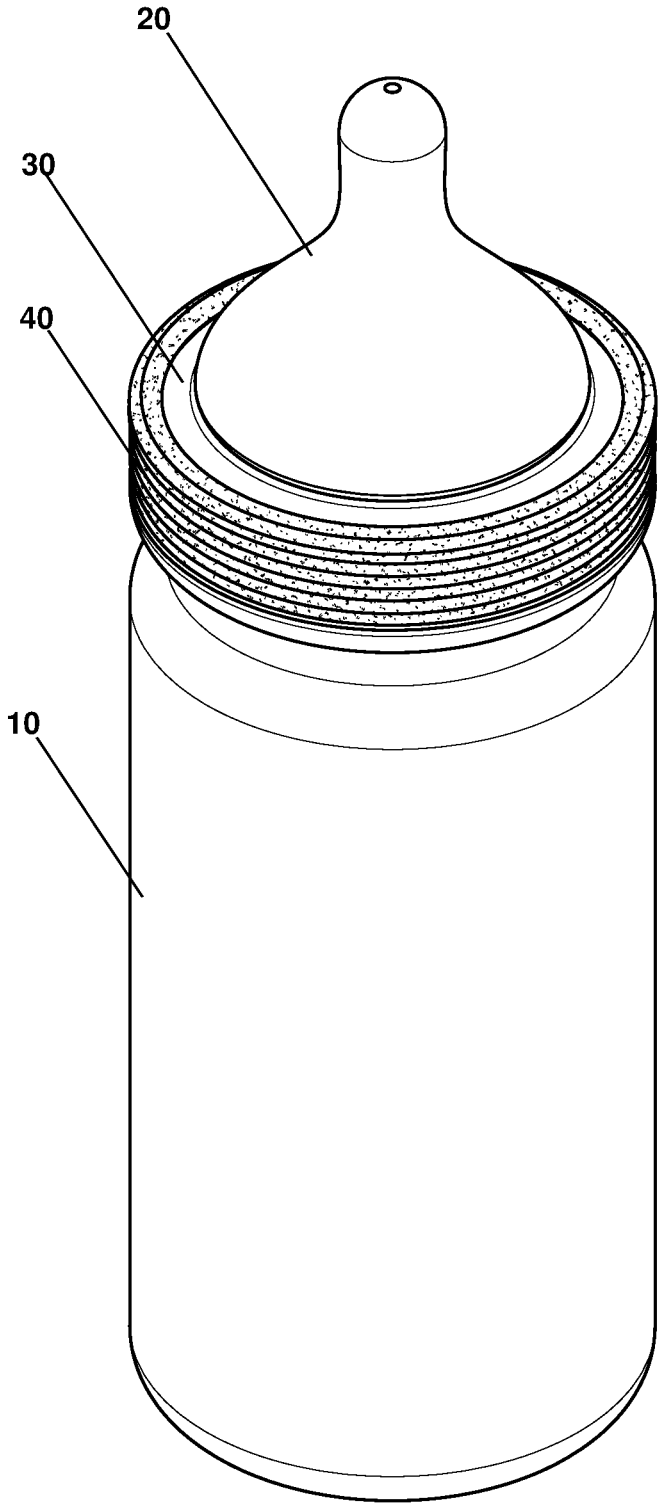
FIG. 2 shows a front and side perspective view of the baby bottle of FIG. 1, with the cover in the compressed configuration.

FIG. 2 shows a front and side perspective view of the baby bottle of FIG. 1, with the cover in the compressed configuration. In this configuration, the cover 40 may wholly or partially fill the groove 32. The cover 40 may furthermore extend and/or bulge outward from the groove 32 in a vertical and/or horizontal direction.

Figure 3:
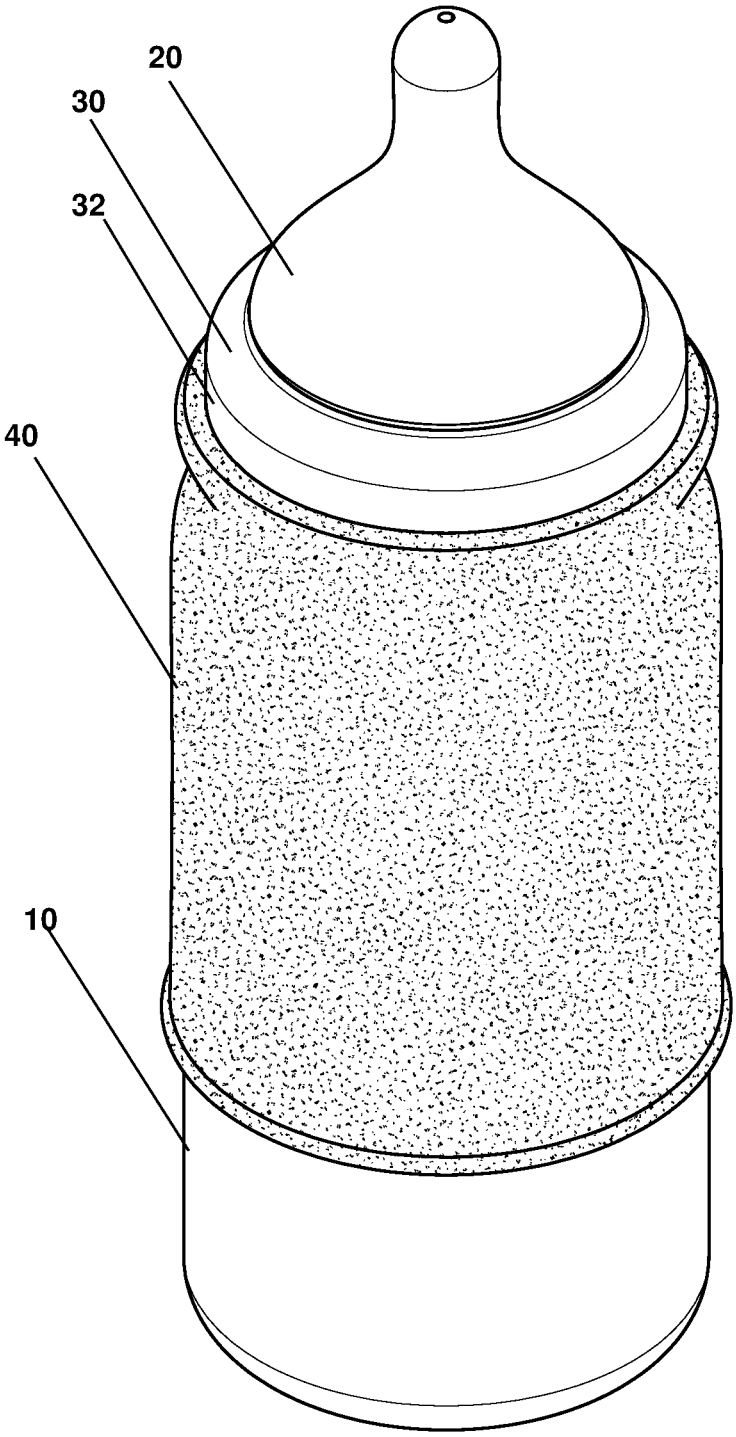
FIG. 3 shows a front and side perspective view of the baby bottle of FIG. 1, with the cover in a downward configuration.

FIG. 3 shows a front and side perspective view of the baby bottle of FIG. 1, with the cover in a downward configuration. In this configuration, the cover 40 may cover substantially a majority of sides of the bottle 10. The cover 40 may be made of a material which adheres to the sides of the bottle 10. The cover 40 may curl and/or fold inward and/or outward upon itself at a bottom edge of the cover 40, or may lie flat against the sides of the bottle 10.

An edge of the cover 40 which remains fixedly connected to the collar 30 while the cover 40 is in a downward configuration may be within and/or outside of the groove 32. The edge of the cover 40 which remains fixedly connected to the collar 30 while the cover 40 is in a downward configuration may further be located at an upper, middle, or lower portion of the groove 32.

A portion of the cover 40 which surrounds a meeting point between the collar 30 and the bottle 10 and/or which surrounds a portion of the bottle 10 and/or the collar 30 in which a circumference of the bottle 10 and/or the collar 30 and/or a meeting point thereof becomes gradually and/or abruptly smaller may have a smaller circumference than a portion of the cover 40 which surrounds a portion of the collar 30 and/or of the bottle 10 which has a largest circumference. In another embodiment, the cover 40 may have a substantially uniform circumference throughout. A bottom edge of the cover 40 may be wholly and/or partially uneven.

Figure 4:
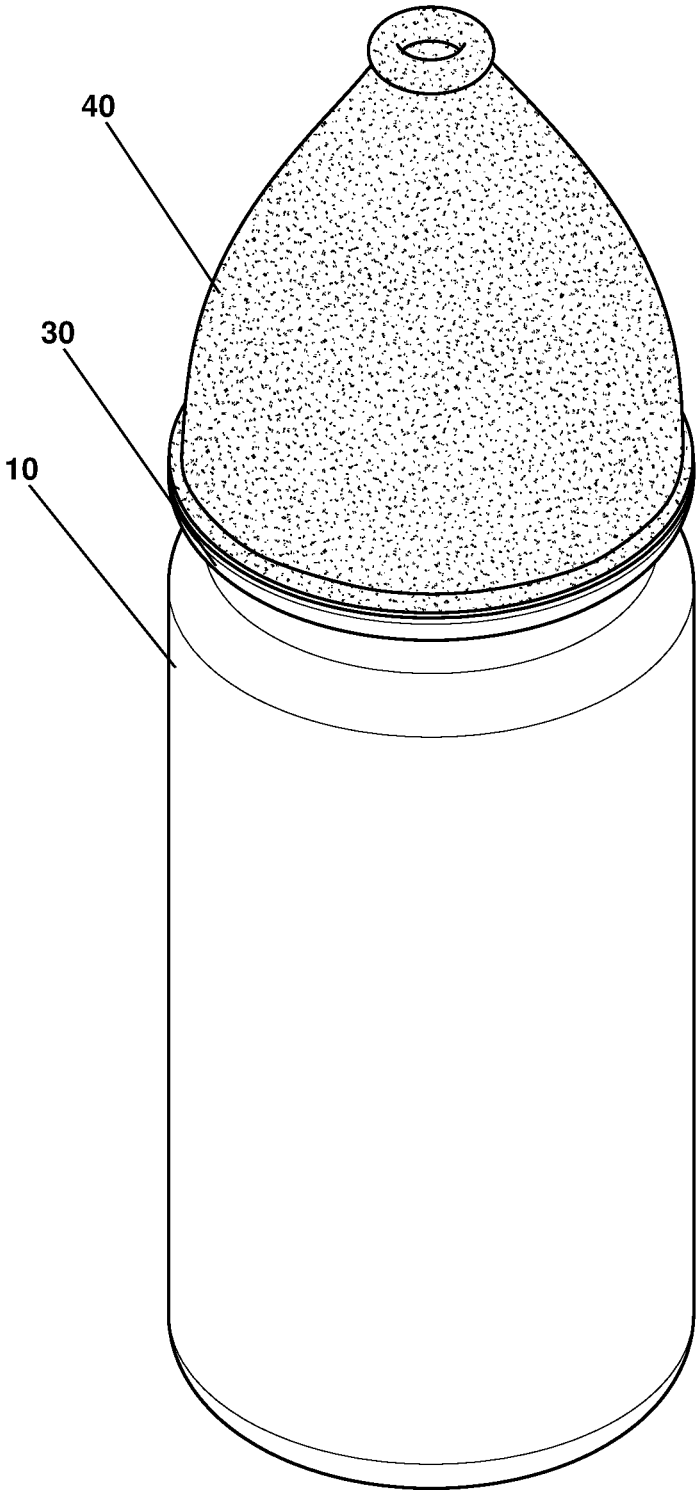
FIG. 4 shows a front and side perspective view of the baby bottle of FIG. 1, with the cover in an upward configuration.

FIG. 4 shows a front and side perspective view of the baby bottle of FIG. 1, with the cover in an upward configuration. In the embodiment shown, an upper edge of the cover 40 curls outward while in this configuration, leaving a small opening at a top of the cover 40. In other embodiments, the upper edge of the cover 40 may curl inward, may fold over itself, and/or may otherwise be positioned in such a way that an area around the nipple 20 is substantially completely sealed off by the cover 40.

In the embodiment shown, the cover 40 follows the general shape of the nipple 20. In other embodiments, the cover 40 may lie flush against either a part or a whole of the nipple 20.

Figure 5:
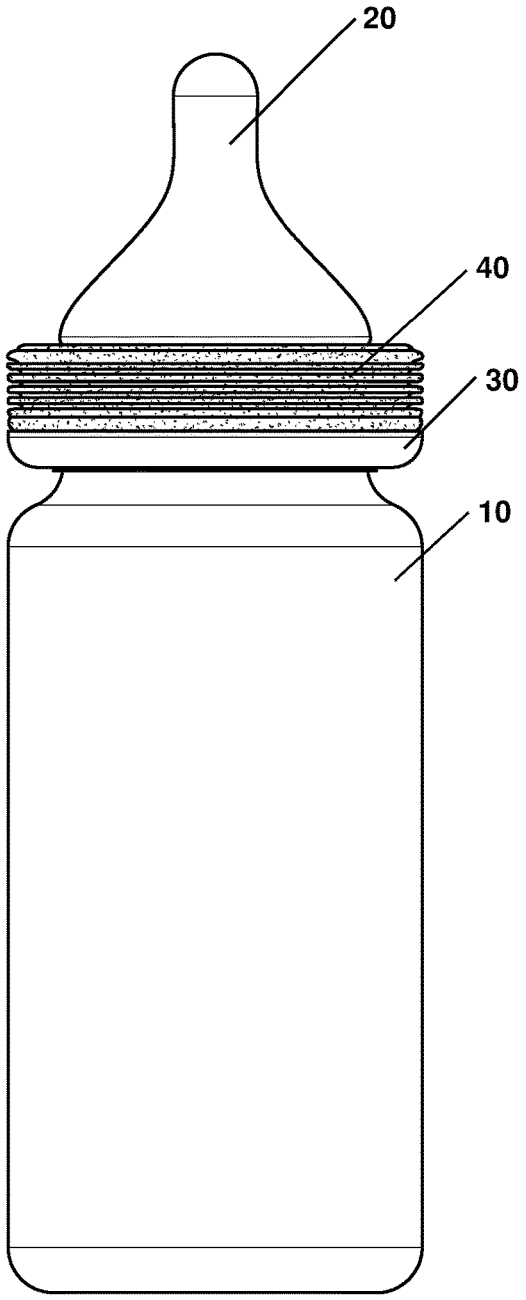
FIG. 5 shows a side elevational view of the baby bottle of FIG. 1, with the cover in the compressed configuration.
Figure 6:
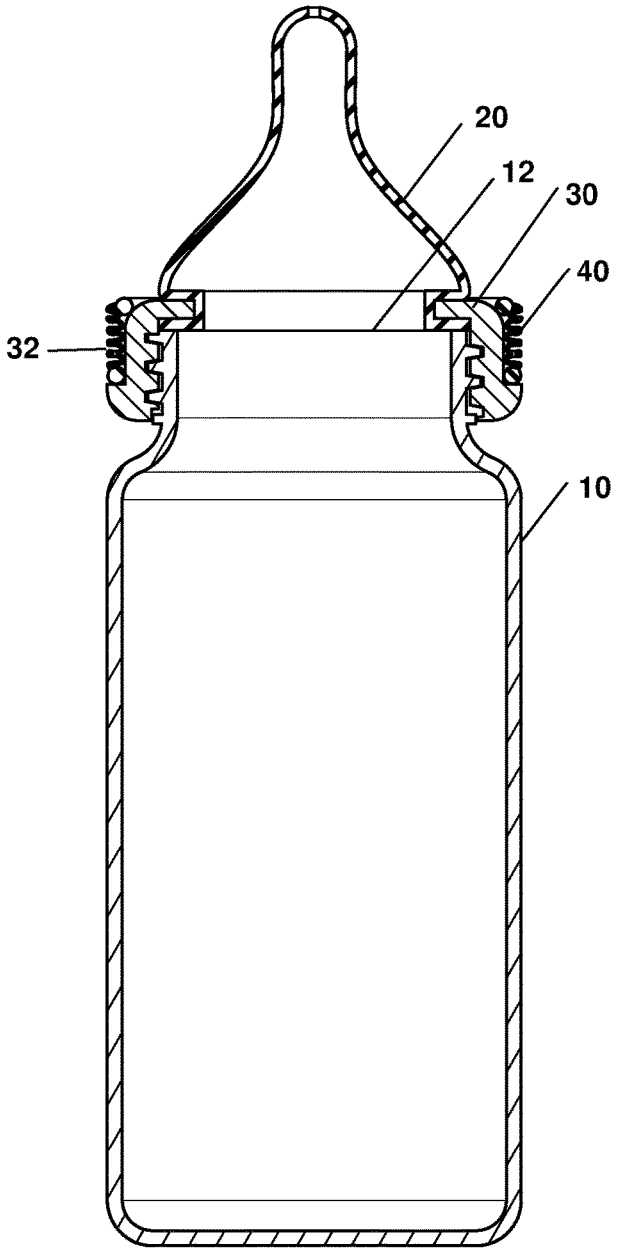
FIG. 6 shows a cutaway side elevational view of the baby bottle of FIG. 1, with the cover in the compressed configuration.

FIG. 5 shows a side elevational view of the baby bottle of FIG. 1, with the cover in the compressed configuration. FIG. 6 shows a cutaway side elevational view of the baby bottle of FIG. 1, with the cover in the compressed configuration. In the embodiment shown in these Figures, a widest portion of the collar 32 has a circumference which is smaller than a largest circumference of the bottle 10. In other embodiments, the widest portion of the collar 32 may have circumference which is larger than and/or equal to a largest circumference of the bottle 10.

Furthermore, in the embodiment shown in these Figures, a widest portion of the cover 40, while in the compressed position, has a circumference which is substantially equal to the circumference of a widest portion of the collar 30. In other embodiments, the widest portion of the cover 40, while in the compressed position, may have a circumference which is greater than and/or less than the circumference of a widest portion of the collar 30.

The groove 32, in the embodiment shown, is located on an outward facing side of the collar 30. In other embodiments, the groove 32 may be located on a downward-facing side and/or on an upward-facing side of the collar 30.

The widest part of the nipple 20, in the embodiment shown, is located above an uppermost part of the collar 30. In other embodiments, the widest part of the nipple 20 may be located partially or wholly within and/or below the collar 30.

Figure 7:
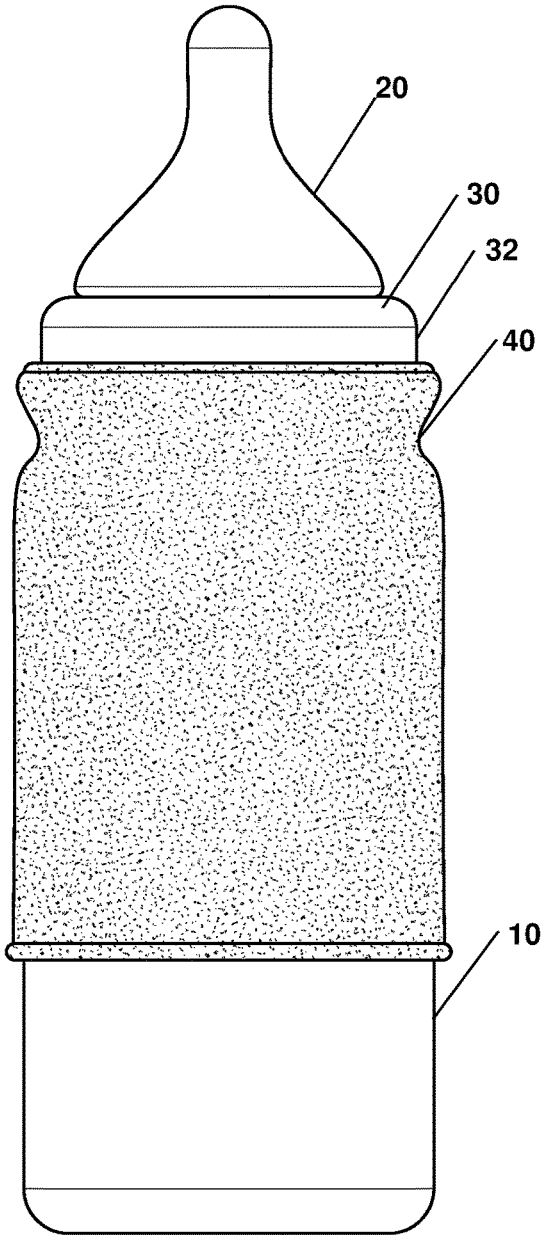
FIG. 7 shows a side elevational view of the baby bottle of FIG. 1, with the cover in the downward configuration.
Figure 8:
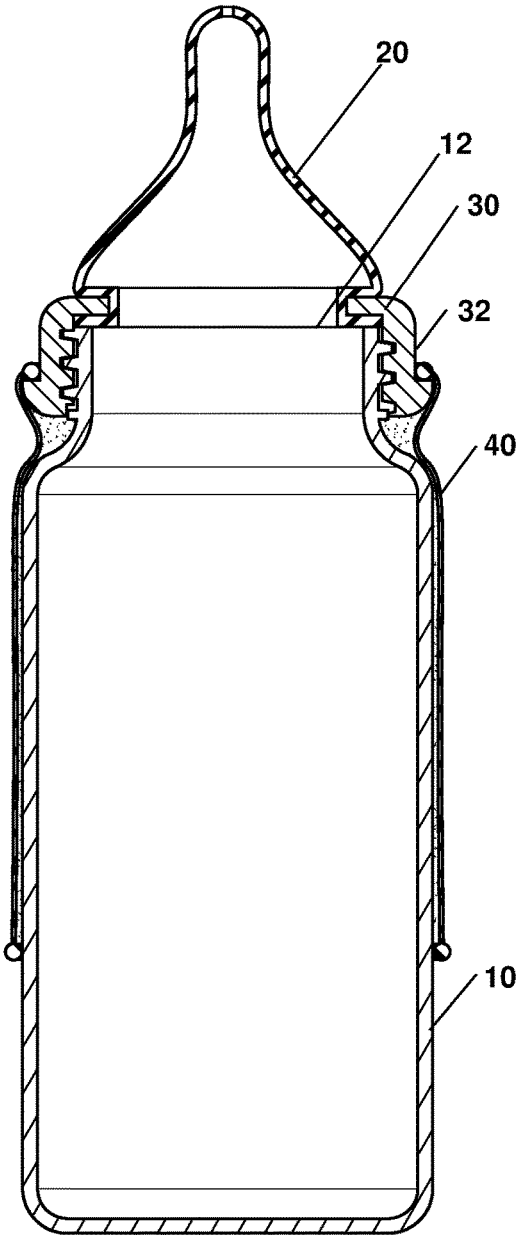
FIG. 8 shows a cutaway side elevational view of the baby bottle of FIG. 1, with the cover in the downward configuration.

FIG. 7 shows a side elevational view of the baby bottle of FIG. 1, with the cover in the downward configuration. FIG. 8 shows a cutaway side elevational view of the baby bottle of FIG. 1, with the cover in the downward configuration. The open end 12 of the bottle 10, in the embodiment shown, has a circumference which is smaller than the largest circumference of the bottle 10. In various other embodiments, the open end 12 of the bottle 10 may have a circumference which is smaller than and/or equal to a largest circumference of the bottle 10.

Figure 9:
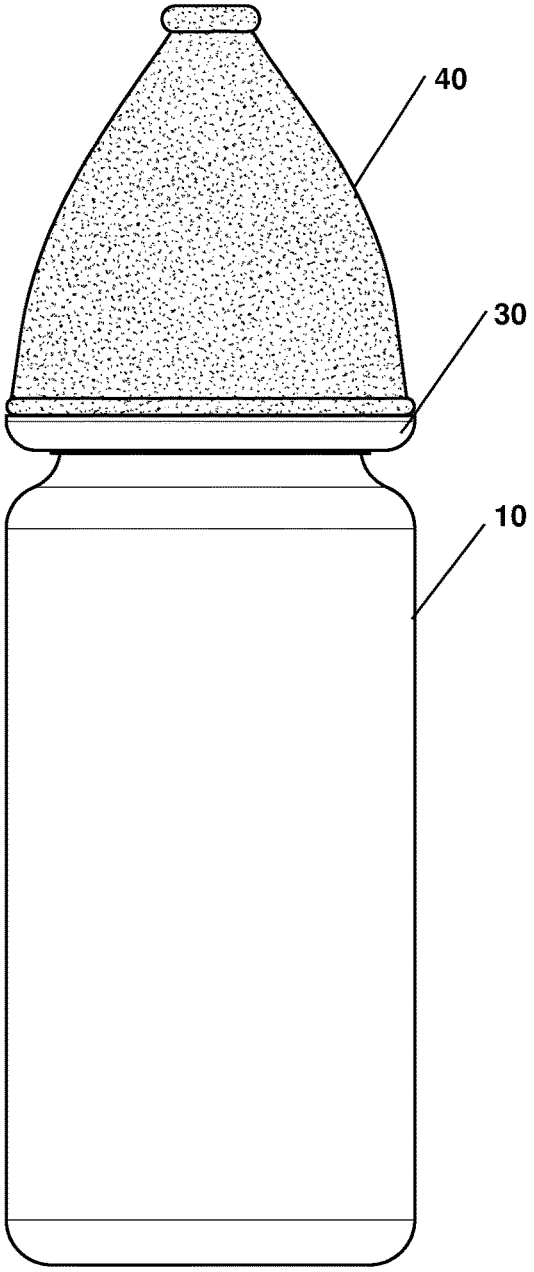
FIG. 9 shows a side elevational view of the baby bottle of FIG. 1, with the cover in the upward configuration.
Figure 10:
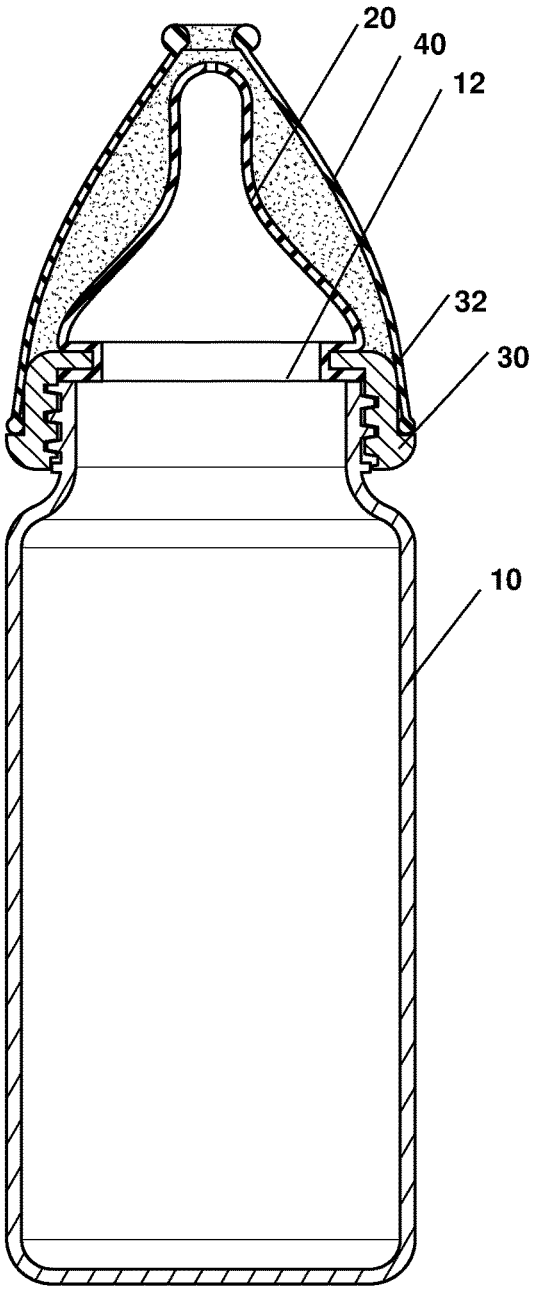
FIG. 10 shows a cutaway side elevational view of the baby bottle of FIG. 1, with the cover in the upward configuration.

FIG. 9 shows a side elevational view of the baby bottle of FIG. 1, with the cover in the upward configuration. FIG. 10 shows a cutaway side elevational view of the baby bottle of FIG. 1, with the cover in the upward configuration. In the embodiment shown, the cover 40 encloses an area above an uppermost part of the nipple 20. In other embodiments, an uppermost part of the cover 40 may lie partially or wholly flush with an uppermost part of the nipple 20.

The collar 30, in the embodiment shown, connects to an uppermost part of the bottle 10 by way of a screwing mechanism utilizing threading. In other embodiments, the collar 30 may connect to the bottle 10 by way of friction, by way of an applied adhesive, or by any other mechanism.

For purposes of this disclosure, the term "substantially" is defined as "at least 95% of" the term which it modifies.

Any device or aspect of the technology can "comprise" or "consist of" the item it modifies, whether explicitly written as such or otherwise.

When the term "or" is used, it creates a group which has within either term being connected by the conjunction as well as both terms being connected by the conjunction.

While the disclosed technology has been disclosed with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A baby bottle comprising:

a bottle;

a nipple connected at an open end of said bottle;

a collar removably connected at a meeting point of said bottle and said nipple; and an accordion cover connected to said collar;

wherein in a compressed condition, said cover has a width equal to or less than the height of a groove in said collar.

2. The baby bottle of claim 1, wherein an upper and lower end of said collar frictionally prevent said cover in said compressed condition from decompressing.

3. The baby bottle of claim 1, wherein said cover is fixedly connected to said groove in said collar.

4. The baby bottle of claim 3, wherein said cover is extendable in an upward configuration covering said nipple while an end of said cover is within and fixedly connected to said groove of said collar.

5. The baby bottle of claim 3, wherein said cover is extendable in a downward configuration covering at least a portion of said bottle while an end of said cover is within and fixedly connected to said groove of said collar.

6. The baby bottle of claim 3, wherein said cover is extendable in both an upward and a downward configuration, relative to said groove of said collar, while remaining fixedly connected to said groove of said collar; and wherein an end of said cover unconnected to said groove extends past a top of said collar around at least a part of said nipple when in said upright configuration and extends past a bottom of said collar around at least a part of said baby bottle when in said downward configuration.

7. The baby bottle of claim 4, wherein a circumference of said cover becomes smaller when uncompressed in said upward configuration.

8. The baby bottle of claim 5, wherein said cover surrounds, and is in contact with, a plurality of outer side circular cross-sections of said bottle when in a lowered position.

9. The baby bottle of claim 3, wherein said groove of said collar has therein a plurality of circumferentially spaced-apart pits;

wherein said cover has a plurality of circumferentially spaced-apart flanges, each flange of said plurality of flanges corresponding to a pit of said plurality of pits.

10. The baby bottle of claim 9, wherein said cover is prevented from rotating relative to said collar, due to said plurality of spaced-apart flanges being within said plurality of spaced-apart pits within said groove, while said cover extends in a direction transverse to said circumferential arrangement of said pits within said groove of said collar.

11. The baby bottle of claim 1, wherein said cover comprises an internally-extending connection mechanism, said mechanism fixedly attached within said groove of said cover.

12. A baby bottle cover comprising:

a collar threadedly attachable to a bottle; and an accordion cover connected to and held within an externally-oriented circumferential groove of said collar.

13. The bottle cover of claim 12, wherein said cover is fixedly attached to said collar.

14. The bottle cover of claim 13, wherein said cover is stretchable away from said collar in each of two opposing directions while substantially retaining circumferential or ovoid cross sections vertically between said groove and an extremity of said cover furthest away from said groove.

15. The bottle cover of claim 14, wherein in one of said opposing directions, an opening of said bottle is in between said groove and an edge of said cover furthest from said groove.

16. The bottle cover of claim 15, wherein a part of said cover above said opening has ovoid cross-sections.

17. The bottle cover of claim 14, wherein in one of said opposing directions, said cover retains said ovoid cross-sections and is circularly abutted against at least a portion of said bottle.

* * * * *